US006745676B2

(12) United States Patent
Mazzoni et al.

(10) Patent No.: US 6,745,676 B2
(45) Date of Patent: Jun. 8, 2004

(54) METHOD AND MACHINE FOR PACKAGING SKEINS, SHAPED AS RINGS, OF A FLEXIBLE, ELONGATED ELEMENT

(75) Inventors: Andrea Mazzoni, Macerata (IT); Marco Mazzanti, Porto Potenza Picena (IT)

(73) Assignee: SICA S.p.A., Alfonsine (IT)

( * ) Notice: Subject to any disclaimer, the term of this patent is extended or adjusted under 35 U.S.C. 154(b) by 0 days.

(21) Appl. No.: 10/338,736

(22) Filed: Jan. 9, 2003

(65) Prior Publication Data

US 2003/0097940 A1 May 29, 2003

Related U.S. Application Data

(62) Division of application No. 09/615,750, filed on Jul. 13, 2000, now Pat. No. 6,546,852.

(30) Foreign Application Priority Data

Aug. 5, 1999 (EP) ..... 99830514

(51) Int. Cl.[7] ..... B65B 13/02

(52) U.S. Cl. ..... 100/2; 100/5; 53/204; 53/589; 53/118

(58) Field of Search ..... 53/409, 204, 116, 53/582, 589, 118, 176; 100/12, 5, 2

(56) References Cited

U.S. PATENT DOCUMENTS

| | | | | |
|---|---|---|---|---|
| 2,835,194 A | | 5/1958 | Crosby | |
| 2,905,078 A | | 9/1959 | Laine | |
| 3,118,367 A | * | 1/1964 | Lindholm | 100/12 |
| 3,675,569 A | * | 7/1972 | Moor | 100/12 |
| 3,678,845 A | * | 7/1972 | Francois et al. | 100/4 |
| 3,973,600 A | * | 8/1976 | Choromokos | 100/12 |
| 4,572,370 A | * | 2/1986 | Cedenblad et al. | 206/398 |
| 5,540,142 A | * | 7/1996 | Mieleszuk et al. | 100/12 |

* cited by examiner

*Primary Examiner*—Stephen F. Gerrity
*Assistant Examiner*—Thanh Truong
(74) *Attorney, Agent, or Firm*—Browdy and Neimark, P.L.L.C.

(57) ABSTRACT

A method for packaging skeins shaped as a circular ring of a flexible element of elongated shape, in particular a cable or a hose, wherein the turns are held unitarily to each other, comprises the following phases: sustaining the skein in overhang towards a binding station holding it by the clamping of opposite planar aces of the skein effected in correspondence with at least a first portion of the skein; binding the skein in correspondence with at least its second, free, portion which projects from the first held portion; rotating the skein around its own axis of symmetry by a predetermined angle with respect to the position of the skein in the previous binding phase; and binding the skein again in correspondence with its own rotated position.

13 Claims, 4 Drawing Sheets

METHOD AND MACHINE FOR PACKAGING SKEINS, SHAPED AS RINGS, OF A FLEXIBLE, ELONGATED ELEMENT

This is a division of U.S. application Ser. No. 09/615,750 filed on Jul. 13, 2001 now U. S. Pat. No. 6,546,852, the disclosure of which is incorporated herein by reference.

BACKGROUND OF THE INVENTION

The present invention relates to the packaging of skeins shaped as circular rings of flexible elements, of elongated shape, such as hoses, cables and the like, and in particular it pertains to a method for packaging the skeins and a packaging machine that implements said method.

The packaging of elongated, flexible, elements into skeins shaped as circular rings currently comprises: a) winding the flexible element onto itself in such a way as to form an ordered succession of turns in mutual contact; and b) connecting the turns together in such a way as to maintain them tightly wound to each other in order to allow the entire skein to be handled as a single body, with no danger that the skein may unravel as a result of the relative displacement of the turns; said connection being hereafter defined with the generic term of binding, regardless of the way said binding is in fact achieved.

The aforesaid packaging is effected by means of various techniques.

A first known packaging procedure provides for the unitary retaining of the turns by means of a certain number of independent bindings, regularly distributed along the skein. Each of these bindings is effected by means of a retaining ring which: is embodied by a strip positioned on its own plane radial to the skein; envelops the turns intersecting their related planes; concatenates with the totality of the turns; and is so tightened as to compress all turns in mutual contact conferring a substantial overall rigidity to the skein.

The aforesaid bindings are obtained by means of machines comprising a certain number of operating heads, or otherwise machines with a single head provided with a plurality of guiding slots, located at regular intervals around the skeins and each forming a ring for holding the turns by dispensing, clamping and cutting a packaging ribbon, commonly called strap, which unwinds from a related coil.

The operating heads are in a well-determined number by construction, so that the related packaging machine can effect a number of bindings exactly corresponding to the number of operating heads, or even a lesser number through the deactivation of one or more heads suitably chosen to allow the formation of bindings regularly distributed along the contour of the skein.

The number and location of the heads with which the machine is provided by construction rigidly condition the operating capabilities of the machine itself. Although in general the possibility of varying the binding pitch is not precluded, the aforesaid packaging machines can in fact produce bindings that are mutually offset according to a rather limited number of different pitches so that such machines are characterized, in actuality, by a high productive rigidity.

A second packaging technique, also known and representing an advance over the previous one, calls for combining with the aforesaid bindings, effected with a strap, a band of plastic film (for instance of heat-shrinking material) which is positioned around the circumference of the skein in such a way as to form an exterior sheath, constituted by a single annular strip that encompasses the cylindrical contour surface of the skein and holds the totality of the turns within it. Such containment sheath serves the fundamental purpose of preventing the skein from unraveling while in use when, after the holding rings lying on the radial planes of the skein have been cut or untied, a certain length of hose or cable is extracted and cut from the skein itself.

This packaging technique obviously retains unaltered all the limitations, in terms of binding pitch options, of the machines that embody the technology discussed above. Moreover, it requires a greater manufacturing complexity of the packaging machines; and lastly it entails a greater quantity of packaging material, with obvious consequences both in terms of production cost and of the disposal of the skein packing.

A third packaging method, known from the patent document MC 98A000074, describes a technique that calls for each ring shaped skein to be wrapped entirely, and externally, from one side and from the other, with successive wraps of an uninterrupted, extensible ribbon. The wraps are effected in such a way as to form a sheath wherein each wrap is located on a plane transverse to the skein itself and angularly offset with respect to the wraps that immediately precede and immediately follow.

This packaging method presents numerous advantages, such as that of allowing packaging with very thin film, hence with considerable material savings, and that of allowing to draw and cut the cable from the skein, from the beginning to the end thereof, without it ever being possible for the skein to unravel.

SUMMARY OF THE INVENTION

The aim of the present invention is to eliminate all the drawbacks of the known solutions, ascribable to the execution of bindings with predetermined pitch by means of a packaging method able to allow holding the turns of the skein together with bindings distanced at regular pitches with respect to the axis of symmetry of the skein, of any amplitude; able to be modulated progressively and selectable on each occasion according to the specific packaging in process and in particular to the dimensions of the various skeins and to the characteristics of the hose or of the cable that constitute them.

According to the present invention, this aim is attained by a method for packaging skeins shaped as a circular ring of a flexible element of elongated shape, such as a cable or a hose, wherein the turns are held unitarily to each other, comprising the following phases:

sustaining the skein towards a binding station holding it by the clamping of opposite planar faces of the skein, said skein sustaining phase being made with skein sustaining in overhang towards the binding station, said sustaining phase being obtained in a feeding station and by means of a skein clamping effected in correspondence with at least a first portion of said skein and effected by a pair of parallel jaws vertically oriented between which the skein is housed;

binding the skein, in correspondence with at least one its second portion projecting from the first portion held, by connecting the turns together either with at least one ring for holding the turns of the skein which is oriented transversely to the skein turns intersecting the turns and concatenating therewith, or with an holding ring which wraps by one self the skein enveloping it solely from the exterior; and rotating the skein around its own axis of symmetry by an angle predetermined with respect to a preceding position of the skein in the previous binding phase, the skein being rotated by the jaws around a direction parallel to the axis of symmetry of the skein and binding the skein again in correspondence with its own rotates position.

The machine has a general configuration that is suited to allow indifferently to realize all binding types with the sole condition of being equipped with the specific type of head corresponding to the different packaging techniques. If the binding station is of the type able to dispense a packing ribbon or a strap, the machine according to the invention allows to realize radial bindings with no constraint limiting the number and distance between the bindings.

If, vice versa, the binding station is embodied by a wrapping head able to dispense a ribbon of plastic film, able to be deformed elastically and longitudinally and uninterrupted, the packaging machine can be set up to provide one of the possible concrete embodiments of the method as per patent application MC 98A000074.

BRIEF DESCRIPTION OF THE DRAWINGS

The technical characteristics of the invention, according to the aforesaid aims, can clearly be noted from the content of the claims below and its advantages shall become more readily apparent in the detailed description that follows, made with reference to the accompanying drawings, which represent an embodiment provided purely by way of non limiting example, in which:

DESCRIPTION OF THE PREFERRED EMBODIMENT

Figures 1, 3:
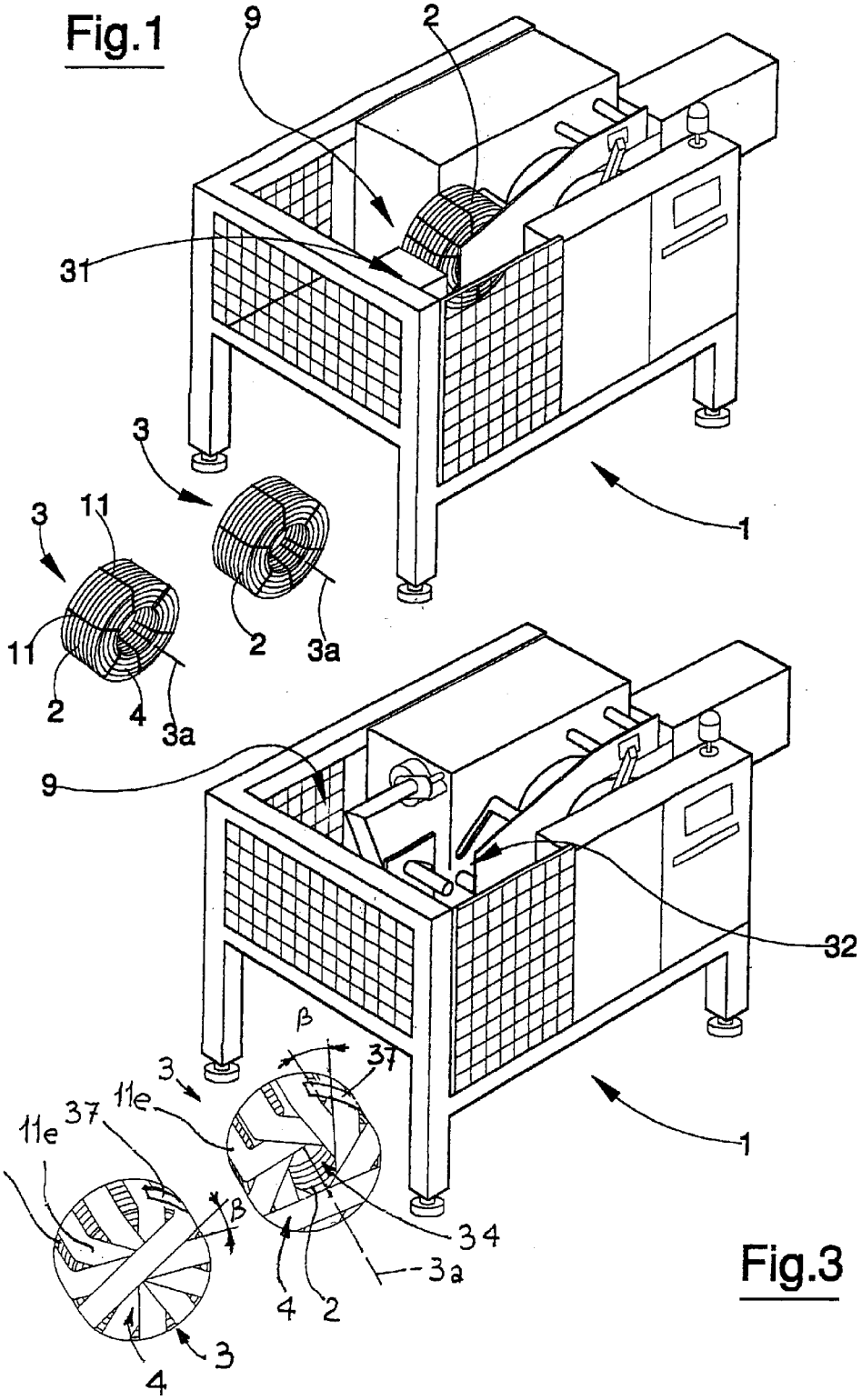
FIG. 1 is a perspective overall view of a first embodiment of the machine according to the invention.
FIG. 3 is a perspective overall view of a second embodiment of the machine according to the invention.

With reference to the drawings of the accompanying figures, a method is described for packaging a flexible element 33 of elongated shape, such as in particular a cable or a hose of plastic or elastic material, in the form of skeins 3 (FIGS. 1 and 3) shaped as a circular ring, comprising a plurality of turns 2, which are held together, or bound, to allow for the easy and convenient handling, transportation, storage, and use of the elongated element, without the unraveling of the skein 3.

More specifically, the flexible element 33, continuously fed in substantially rectilinear form and according to the direction of advance indicated with arrow 6, is at first repeatedly wound onto itself to form the skein 3 and is then suitably bound in such a way that it remains stable in its wound condition.

The winding is performed conventionally. The packaging of the already wound skein 3, which instead is the specific subject of the present invention, comprises the following phases:

sustaining the skein 3 in overhang towards a binding station 9 holding it by the clamping of opposite planar faces 4 of the skein 3 effected in correspondence with at least a first portion 5*a* of said skein 3;

binding the skein 3 in correspondence with at least its second, free, portion 5*b* which projects from the first held portion 5*a;* rotating the skein 3 around its own axis of symmetry 3*a* by a predetermined angle β with respect to the position of the skein 3 in the previous binding phase; and binding the skein 3 again in correspondence with its own rotated position.

The succession of phases, which can be repeated several times, to effect multiple bindings, as shall become readily apparent below, finds its concrete realization in a packaging machine 1 which essentially comprises: a winding station 12; a feeding station 8; and a binding station 9 arranged in series.

The winding station 12 essentially comprises a drum 35 able to rotate around a horizontal axis 14 and a motor-driven reel 13 coaxial to the drum 35.

The reel 13 is able to rotate around the horizontal axis 14, integrally with a shaft 20 driven in rotation by a gear motor 21; it is borne laterally projecting from a vertical side 15 of the machine 1 and it is movable along the axis of rotation of the drum 35, i.e. perpendicularly to the side 15, bi-directionally, upon the activation of related actuation means embodied by a fluid-driven linear actuator.

The drum 35 has a first flange 16 fixed and substantially coplanar with the side 15. A second flange 17 of the drum 35 is supported by a frame 18 translatable on guides 19 oriented parallel to the axis 14 of rotation of the drum 35.

Adjustment means, comprising an adjusting screw 22 with hand-wheel 23 are operatively situated between the side 15 and the frame 18 that supports the second flange 17. The actuation of the adjusting means 22,23 allows to move the flanges 16,17 of the drum 35 closer or, vice versa, farther away, in order to allow the forming between them of skeins 3 differing in dimensions and number of layers of turns 2.

Below the reel 13, the winding station 12 comprises an L shaped support 24, fitted with related motor-driving means 25, which support can be associated to the flanges 16,17 of the drum; it is alternatively movable between the winding station 12 and the binding station 9 and it is able to receive the skein 3 from the drum 35 and to transfer it into the feeding station 8.

More in particular, upon completion of the skein 3, the reel 13 is extracted from the drum 35, perpendicularly to the side 15, whilst the skein 3, which remains contained in position between the flanges 16 and 17 of the drum 35 is taken up by the L-shaped support 24. The latter, which together with its own motor-driving means 25 provides concrete embodiment to more general transfer means operating in phase co-ordination with the motion of the reel 13, then transfers the skein 3 from the winding station 12 to the feeding station 8 situated downstream.

It is important to note that the movement of extracting and inserting the reel 13, with respect to the drum 35 and perpendicularly to the side 15, is very fast so that the skein 3 is freed in a very short time from the central position of the reel 13, thus being able to be thrust by the L-shaped support 24 without hindrance, whereupon the reel 13 can return to its working position necessary to start a new skein 3. Since these operations occur in a few seconds, such characteristics are revealed to be significantly advantageous with respect to traditional machines provided with automatic coil winder change and in particular slaved to continuous working lines wherein the products advance at high speed.

The feeding station 8 is provided with a pair of parallel, planar and vertically oriented jaws 10, between which the skein 3 is positioned, with one supported by the side 15 and the other by the frame 18.

The jaws 10 preferably have the shape of planar circular sectors, which are able to rotate around an axis of rotation

10*a* passing in proximity of their vertex and are movable relatively to each other along the axis of rotation 10*a* to be able to translate according to the direction of the axis of rotation 10*a*, to vary their relative distance and correspondingly to clamp the skein 3 interposed to them.

For the jaw 10, which is integral to frame 18, this freedom of motion is solely for adjustment purposes and it is obtained indirectly as a consequence of the possibility of making the frame 18 translate along its own guides 19. For the jaw 10 supported instead by the side 15, the translation is obtained directly and by means of the support of the jaw 10 itself on bars 26 oriented parallel to the axis of rotation 10*a* and mounted on related sliding guides 27.

The jaws 10 are driven in rotation around the axis 10*a* and, in relative translation, along said axis 10*a*, by actuating means comprising first and second linear actuators 28 and 29, preferably embodied by fluid-driven pistons.

The first linear actuators 28—whereof only one is visible from the figures—are operatively interposed, in correspondence with a first side of the machine 1, to the frame 18 and to the corresponding jaw 10 supported thereby; and in correspondence with the opposite side of the machine 1 they are instead interposed to the side 15 and to a revolving frame 30, which in turn supports the jaw 10, the bars 26 and the sliding guides 27.

The first linear actuators 28 act on parallel planes, orthogonal to the axis of rotation 10*a*.

The second linear actuators 29 instead act in a direction parallel to the axis of rotation 10*a* of the jaws moving the related jaw 10 closer to or farther away from the frame 30 that supports it.

The constructive shape of the jaws 10 allows such a positioning of the skeins 3 in the feeding station 8 that the skeins 3, when they arrive in the feeding station 8, are held in partial overhang towards the binding station 9.

The skeins 3 embody, summarily, more general clamping means which, operating on opposite planar faces 4 of the skein 3, act solely in correspondence with a first portion 5*a* thereof; and which allow to impart to the skein 3 angular excursions of desired amplitude, in rotation around its own axis of symmetry 3*a*, as a consequence of the activation, suitably coordinated in phase, of the actuator means 28,29. Lastly, the jaws 10 allow to sustain the skein 3 with a second portion 5*b* projecting in overhang towards the binding station 9.

Figure 2:
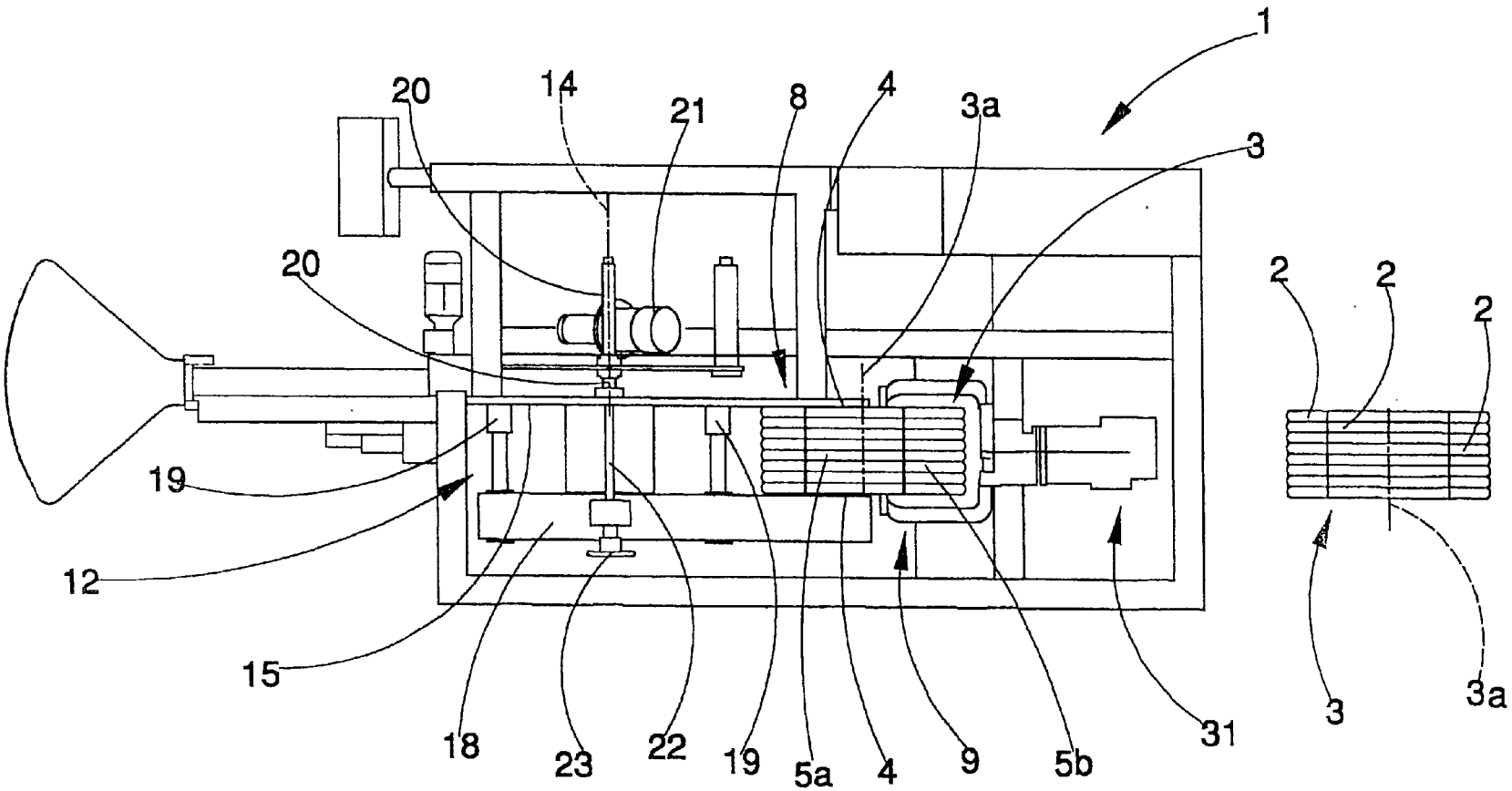
FIG. 2 is a top plan view of the machine of FIG. 1.
Figure 4:
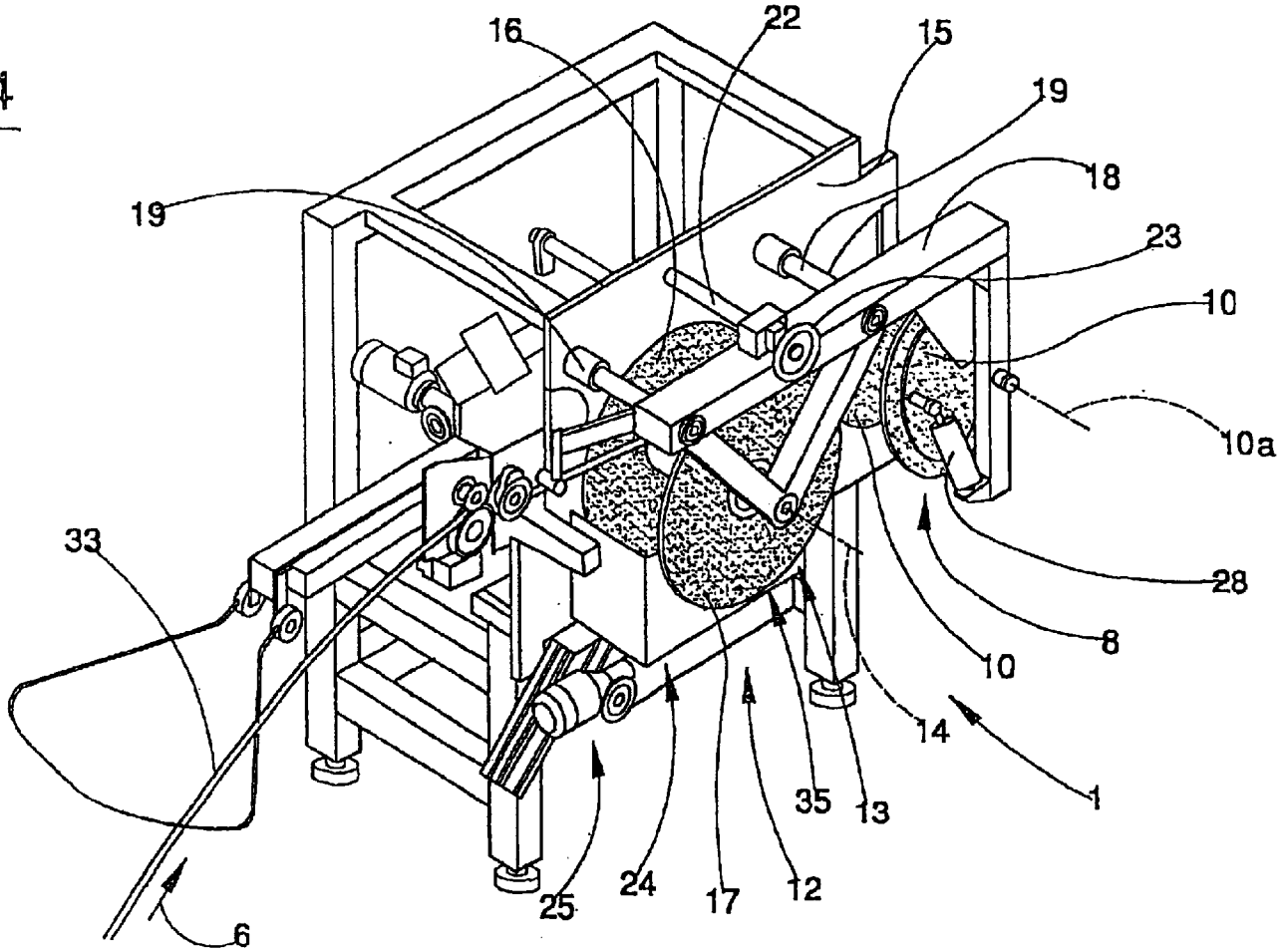
FIG. 4 is a front side perspective view of the machine shown with some parts removed the better to highlight others.
Figure 5:
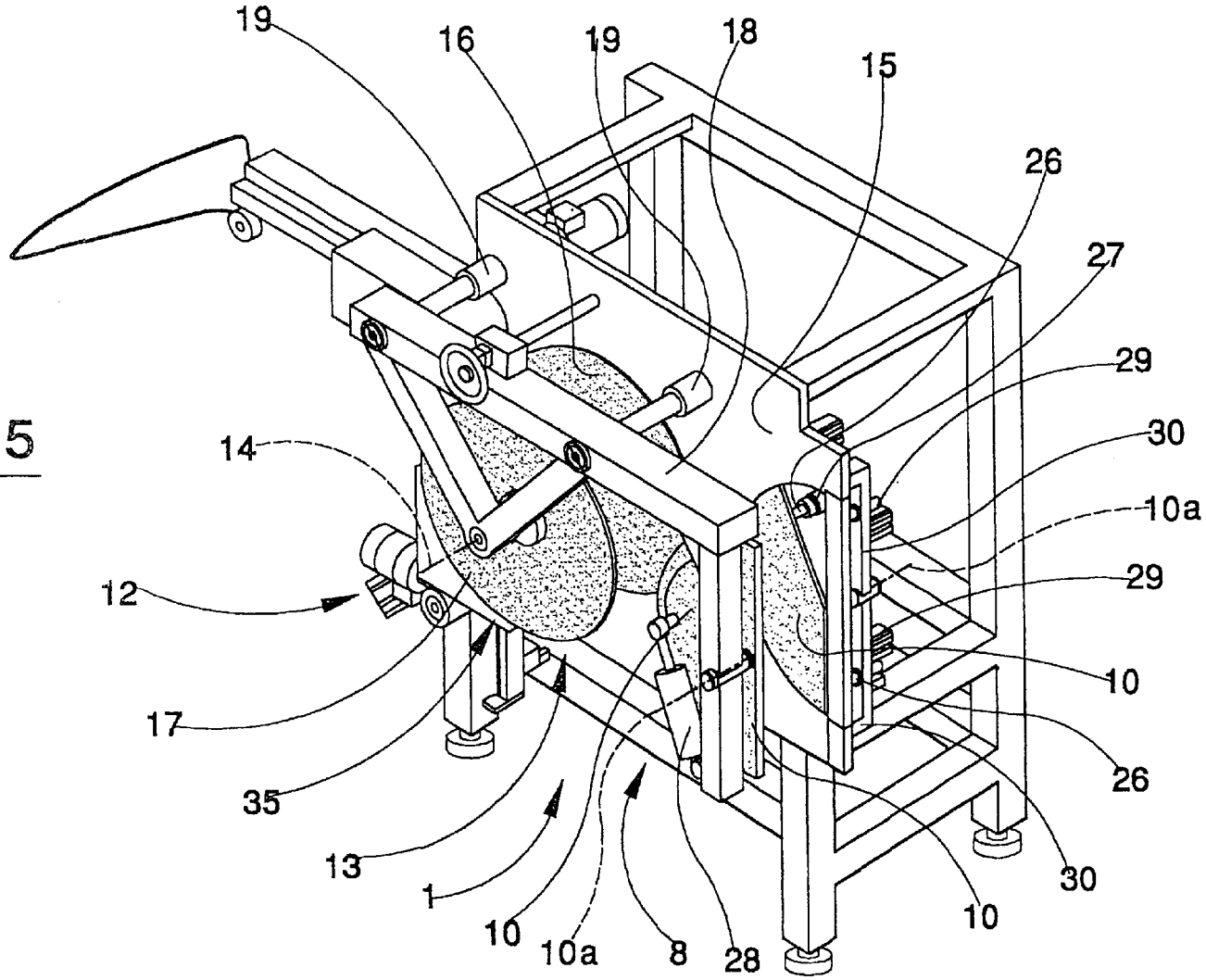
FIG. 5 is a rear side perspective view of the machine in FIG. 4.

The binding station 9 can be obtained in general by means of at least two different embodiments, whereof the first one is shown in FIGS. 1 and 2, the other one instead being shown in FIG. 3.

In the first embodiment, the binding station 9 is fitted with a single operating head 31 which operates on the second portion 5*b* of the skein 3 and which is so designed as to effect bindings of the turns 2 in appropriate phase relationship with the rotations imparted to the skein 3 by the jaws 10 of the feeding station 8.

The operating head 31 (FIG. 2) is of conventional construction and it is suited to effect bindings of the type that form a holding ring 11 of the turns 2 of the skein 3, which ring is oriented transversely to the turns 2 and radially intersects the turns 2 of the skein 3 itself concatenating therewith, as FIG. 1 clearly shows. The holding ring 11 can be obtained by means of a strip of conventional packing ribbon or by means of a strap made of metallic or plastic material.

An alternative construction of the binding station 9 can be obtained by means of an operating head 32, conventionally shaped in itself, able to effect a wrapping of the second portion 5*b* by means of a continuous strip of packing material embodied in particular by a film able to be deformed elastically and longitudinally.

In this case the ring 11 for holding the skein 3 is obviously single and it is constituted by an uninterrupted succession of elementary wraps 11*e* which envelop the entire skein 3 solely from the exterior. The elementary wraps 11*e* are partly superposed on each other. Moreover, each of the elementary wraps 11*e* lies in its own surface, substantially planar, offset in phase with respect to the surfaces whereon the preceding and the following elementary wrap 11*e* lie by an appropriate angle β defined around the axis of symmetry 3*a* of the skein 3 (FIG. 3). The angles β are programmable with amplitudes varying at will and are not subject to limits of any sort, unlike in traditional machines, wherein bindings can be effected only between one radius and another.

If the elementary wraps 11*e* are obtained in such a way as to intersect the planar faces 4 of the skeins 3 substantially along chords of the related circular shape, an outer covering sheath of the entire skein can be obtained, provided with a hole 34 situated in proximity to the axis of the skein 3; hole which vice versa is lacking if the elementary wraps 11*e* are offset in phase in such a way as to intersect the aforesaid planar faces 4 substantially along the various diameters of the circular shape of the planar faces of the skein 3. The presence or absence of the hole 34 can be advantageous, depending on specific application circumstances. In packages effected by wrapping along the chords the presence on the covering sheath of the skein 3 of a free, through central hole 34 is useful to facilitate gripping and transporting the skein 3 and, briefly, to facilitate its handling.

In the packages wherein the wrapping is instead effected along the diameters, the realization of a totally closed covering, lacking the hole 34, enables to isolate the skein from possible contact with extraneous substances (in particular dust), whilst allowing to provide a useful surface of the sheath for the application of labels.

The operation of the machine 1 is controlled automatically by direction and control means, not shown herein, which impart the commands in sequence and in suitable phase scan to the winding station 12, feeding station 8 and binding station 9.

The detailed description of such operation is omitted as it can-be completely deduced, with no need for additions to the preceding discussion. The observation shall merely be provided that, by activating the clamping and rotation of the jaws 10 in appropriate phase relationship with the binding station 9 and with appropriate amplitude of the travel of the first linear actuators 28, it is possible to impart to the skein 3 rotations of angular amplitude suitable to allow the realization of bindings of the turns 2 positioned around the axis of symmetry 3*a* of the skein 3 in any number whatsoever. This feature is very advantageous in that the same machine 1 can be set up with a few simple adjustments, possibly automated and controlled directly by the control means, to tackle packaging problems of a general nature which can be referred to elongated elements 33 with different geometric and physical characteristics; and/or to skeins 3 of different dimensions.

In regard to the fastening of the film employed to bind the skeins 3 by continuous wrapping, it should be observed that at the end of the packaging operation, the film is cut and, with slight pressure, is thrust against the wrapping that has just been obtained whereto it adheres spontaneously by electrostatic adhesion. A different fastening method instead provides for the employment of an adhesive label 37 which is applied to an end of the film strip and to the underlying wrapping, as shown in FIG. 3.

The machine according to the invention, in addition to allowing to obtain with the utmost operative flexibility the realization of various types of packaging and the achievement of the most suitable packaging for each specific product, also allows a considerable constructive standardization of the packaging machines. The shift from one configuration to another for these machines can be obtained by means of the diversification of only the operating heads 31 or 32, with the consequent advantageous implications in terms of reduced production costs and, therefore, in terms of reduced sale prices.

Lastly, it is important to observe that the constructive modularity of the machine 1, in particular regard to the feeding station 8 and the binding station 9, can be exploited to realize also autonomous, off-line, winding machines, which can advantageously effect, for instance for protection purposes, also the continuous wrapping with film of a skein 3 which has already been bound with a strap. In this case, then, once the skein 3 has been formed and bound conventionally it can be made to reach the feeding station 9, whereupon the machine 1 executes the wrapping and the final packaging in a manner identical to the one described above.

What is claimed is:

1. Method for packaging a skein shaped as a circular ring of a flexible element of elongated shape, wherein the turns are held unitarily to each other, comprising the following phases:

sustaining the skein towards a binding station holding it by the clamping of opposite planar faces of the skein, said skein sustaining phase being made with skein sustaining in overhang towards the binding station, said sustaining phase being obtained in a feeding station and by means of a skein clamping effected in correspondence with at least a first portion of said skein and effected by a pair of parallel jaws vertically oriented between which the skein is housed;

binding the skein, in correspondence with at least a second portion projecting from the first portion held, by connecting the turns together either with at least one ring for holding the turns of the skein which is oriented transversely to the skein turns intersecting the turns and concatenating therewith, or with a holding ring that holds the turns of the skein by wrapping the entire skein solely from the exterior;

rotating the skein around its own axis of symmetry by an angle predetermined with respect to a preceding position of the skein in a previous binding phase, the skein being rotated by the jaws around a direction parallel to the axis of symmetry of the skein; and binding the skein again in correspondence with its own rotation position.

2. Method according to claim 1, wherein said sustaining phase is made in a winding station preceding said pair of parallel jaws and provided with a drum that is able to rotate around an axis of rotation and with a reel for winding the elongated element on the drum, which reel is mounted coaxial to the drum and is motor driven to be movable with respect to the axis of rotation of the drum in order to be able to be extracted to free the formed skein, contained in the drum and subsequently reintroduced into the drum for the formation of a new skein; said method further comprising a transferring phase wherein the skein is transferred from the winding station to the feeding station by transfer means operating in phase co-ordination with the motion of the reel with respect to the drum.

3. Method according to claim 2, wherein said skein transferring phase comprises an operation of containing the skein performed in combination between flanges of the drum, between the jaws and the transfer means.

4. Method according to claim 3, wherein the transfer means comprise a support shaped to associate itself to the flanges of the drum and to sustain the skein interposed thereto, said support being alternatively movable between the winding station and the feeding station in the space interposed to the flanges of the drum and upon activation of related motor-driving means.

5. Method according to claim 1, wherein said ring holding and enveloping the skein is single and is constituted by an uninterrupted succession of superposed elementary wraps, each of which lies in its own substantially planar surface, offset in phase with respect to the surfaces of the preceding and the following elementary wraps.

6. Method according to claim 5, wherein said ring holding and enveloping the skein is provided with said elementary wraps which are mutually offset in phase around the axis of symmetry of the skein in such a way as to intersect the planar faces of the skein substantially along chords of the circular shape of said planar faces, said wraps being positioned in such a way as to determine in the covering of the skein the formation of at least one central hole able to facilitate handling of the skein.

7. Method according to claim 5, wherein said elementary wraps are offset in phase around the axis of symmetry of the skein in such a way to intersect its planar faces substantially along diameters of the circular shape of said planar faces determining the formation of a covering of the skein that is totally closed to prevent any possible contact of the skein with extraneous substance and/or to allow the application of a label.

8. Method according to claim 1, wherein said ring holding and enveloping the skein is provided with said elementary wraps which are mutually offset in phase around the axis of symmetry of the skein by angles programmable with amplitudes which can be varied at will.

9. Method according to claim 8, wherein the amplitudes of said angles can be continuously varied.

10. Method according to claim 1, wherein said one or each holding ring is embodied by a strip of packing material.

11. Method according to claim 10, wherein said strip of packing material is embodied by a film that is able to be deformed elastically and longitudinally.

12. Method according to claim 10, wherein said strip of packing material is a strap.

13. Method according to claim 1, wherein said skein is a cable or a hose.

* * * * *